US009010143B2

(12) United States Patent
Ashida

(10) Patent No.: US 9,010,143 B2
(45) Date of Patent: Apr. 21, 2015

(54) AIR CONDITIONER

(75) Inventor: Kenji Ashida, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 808 days.

(21) Appl. No.: 13/060,550

(22) PCT Filed: Mar. 31, 2009

(86) PCT No.: PCT/JP2009/056594

§ 371 (c)(1),
(2), (4) Date: Feb. 24, 2011

(87) PCT Pub. No.: WO2010/023986

PCT Pub. Date: Mar. 4, 2010

(65) Prior Publication Data

US 2011/0154845 A1 Jun. 30, 2011

(30) Foreign Application Priority Data

Aug. 25, 2008 (JP) ..... 2008-215544

(51) Int. Cl.
*F24F 1/30* (2011.01)
*F24F 1/36* (2011.01)
(Continued)

(52) U.S. Cl.
CPC ... *F24F 1/30* (2013.01); *F24F 1/36* (2013.01); *F24F 2011/0089* (2013.01); *F25B 13/00* (2013.01); *F24F 2013/227* (2013.01); *F25B 47/006* (2013.01)

(58) Field of Classification Search
CPC ..... F25B 47/006
USPC ..... 62/277, 81, 151, 278
See application file for complete search history.

(56) References Cited

U.S. PATENT DOCUMENTS 2,955,439 A * 10/1960 Pinter ..... 62/278
3,077,084 A * 2/1963 De Kanter ..... 62/278
(Continued)

FOREIGN PATENT DOCUMENTS

CN 2407278 Y 11/2000
CN 1719144 A 1/2006
(Continued)

OTHER PUBLICATIONS

International search report dated Jun. 2, 2009 for PCT/JP2009/056594.

*Primary Examiner* — Mohammad M Ali
*Assistant Examiner* — Raheena Rehman
(74) *Attorney, Agent, or Firm* — Birch, Stewart, Kolasch & Birch, LLP

(57) ABSTRACT

An air conditioner includes a refrigerating cycle including a compressor (10) compressing a refrigerant, an indoor heat exchanger (30) exchanging heat between the refrigerant and indoor air, a pressure-reducing expansion valve (50) reducing pressure of and expanding the refrigerant, and an outdoor heat exchanger (60) exchanging heat between the refrigerant and outdoor air. The air conditioner further has a base plate (70) arranged below the outdoor heat exchanger (60) and having a drain outlet (71) formed at a position opposing an undersurface of the outdoor heat exchanger (60). Between the outdoor heat exchanger (60) and the base plate (70), a freeze prevention pipe (41) is disposed in a manner, in plan view, to at least partially pass inside the region of the drain outlet (71). The freeze prevention pipe (41) is connected between the outdoor heat exchanger (60) and the indoor heat exchanger (30). With such a configuration, discharge of drain water can be maintained by preventing drain water from freezing or by thawing frozen drain water, while achieving lower power consumption.

5 Claims, 7 Drawing Sheets

(51) Int. Cl.

| | |
|---|---|
| ***F25B 47/00*** | (2006.01) |
| *F24F 11/00* | (2006.01) |
| *F25B 13/00* | (2006.01) |
| *F24F 13/22* | (2006.01) |

(56) References Cited

U.S. PATENT DOCUMENTS

| | | | | | |
|---|---|---|---|---|---|
| 4,748,828 | A | * | 6/1988 | Chang | 62/290 |
| 5,473,910 | A | * | 12/1995 | Atterbury et al. | 62/323.1 |
| 6,065,299 | A | * | 5/2000 | Chen | 62/277 |
| 6,343,480 | B1 | * | 2/2002 | Correa et al. | 62/288 |
| 7,284,388 | B2 | * | 10/2007 | Yoshida | 62/285 |
| 7,430,877 | B2 | * | 10/2008 | Davenport et al. | 62/285 |
| 2005/0044861 | A1 | * | 3/2005 | Cho | 62/81 |
| 2007/0130967 | A1 | * | 6/2007 | Park et al. | 62/151 |
| 2008/0028773 | A1 | * | 2/2008 | Lee et al. | 62/80 |

FOREIGN PATENT DOCUMENTS

| | | | | |
|---|---|---|---|---|
| CN | 1719145 | A | | 1/2006 |
| CN | 1719146 | A | | 1/2006 |
| JP | 58-49878 | A | | 3/1983 |
| JP | 60-77974 | U | | 5/1985 |
| JP | 61-133775 | U | | 8/1986 |
| JP | 62-6617 | U | | 1/1987 |
| JP | 63-32273 | U | | 3/1988 |
| JP | 63-210581 | A | | 9/1988 |
| JP | 63-178762 | U | | 11/1988 |
| JP | 63-178762 | U | * | 11/1988 |
| JP | 4-103943 | A | | 4/1992 |
| JP | 06117735 | A | * | 4/1994 |
| JP | 10-300131 | A | | 11/1998 |
| JP | 2002-340386 | A | | 11/2002 |
| JP | 2004-218861 | A | | 8/2004 |
| JP | 2005-49002 | A | | 2/2005 |
| JP | 2005049002 | A | * | 2/2005 |

* cited by examiner

AIR CONDITIONER

TECHNICAL FIELD

The present invention relates to an air conditioner, and in particular to an air conditioner having a freeze prevention pipe.

BACKGROUND ART

When heating operation of an air conditioner causes frost to form at an outdoor heat exchanger arranged within an outdoor unit, defrosting operation, which is a reverse-cycle operation to heating operation, is performed in order to melt the frost. Upon performing defrosting operation, the outdoor heat exchanger functions as a condenser to dissipate heat, and the formed frost is thawed. Melting of the frost produces thaw water, which falls down from the outdoor heat exchanger and is collected as drain water at a base plate arranged below the outdoor unit and discharged from a drain hole provided in the base plate.

When this defrosting operation is performed under such a severely cold environment that the outdoor temperature stays below the freezing point, drain water flew out to the base plate is cooled to freeze before arriving at the drain hole and becomes no longer dischargeable from the drain hole. Frozen drain water gradually grows larger on the base plate, and eventually causes destruction of the outdoor heat exchanger, an outdoor fan or the like. In addition, even when it does not reach to the point that drain water freezes during flowing out, snow or the like blown into the inside of the outdoor unit or on the base plate may hinder discharge of drain water, which results in freezing of the undischarged drain water, which causes destruction of the outdoor heat exchanger or the like.

To avoid such problems, a water heater in which a portion of high-pressure-side refrigerant piping of a refrigerating cycle is arranged above a base plate is disclosed in a prior art document, Japanese Patent Laying-Open No. 2004-218861 (Patent Document 1). Japanese Patent Laying-Open No. 2004-218861 discloses a drain-pan freeze-prevention structure in which refrigerant piping for freeze prevention is routed in a heat-transmittable manner above a drain pan comprised of base plates and located below an air heat exchanger. Further, an evaporator having a structure in which a refrigerant at a high temperature is allowed to pass through the bottom piping of an outdoor heat exchanger in defrosting operation, thereby increasing an amount of heat given to frost on the drain pan to facilitate thawing of frost is disclosed in a prior art document, Japanese Patent Laying-Open No. 58-49878 (Patent Document 2). An air conditioner having a structure in which a drain outlet is provided below an outdoor heat exchanger, and the vicinity of a drain route is heated by a heater or a base plate heater is disclosed in a prior art document, Japanese Patent Laying-Open No. 2005-49002 (Patent Document 3).

Patent Document 1: Japanese Patent Laying-Open No. 2004-218861

Patent Document 2: Japanese Patent Laying-Open No. 58-49878

Patent Document 3: Japanese Patent Laying-Open No. 2005-49002

DISCLOSURE OF THE INVENTION

Problems to be Solved by the Invention

When a heater is employed as a source of heat for heating a drain pan, high power consumption is an obstacle in achieving energy saving. When refrigerant piping which is on a high-pressure side of a refrigerating cycle is used as a source of heat for heating a drain pan, lower power consumption than that of a heater can be achieved; however, without effective use of the heat dissipated by the high-pressure-side refrigerant piping, thawing of frost cannot be effectively performed. Patent Document 1 does not describe the positional relationship between the high-pressure-side refrigerant piping and the drain outlet for discharging drain water and discloses nothing leading to a structure in which thawing of frost can be effectively performed with suppressed power consumption. Since the evaporator described in Patent Document 2 employs a drain pan heater, lower power consumption cannot be achieved sufficiently. The air conditioner described in Patent Document 3 is provided with the drain outlet below the outdoor heat exchanger. In the air conditioner described in this document, however, the base plate heater is provided in the proximity of a lateral part of the drain outlet, which results in heating of frost through the base plate and large heat loss. This causes a large increase in power consumption.

The present invention has been made in view of the problems above, and an object of the invention is to provide an air conditioner in which discharge of drain water can be maintained by preventing drain water from freezing or by thawing frozen drain water, while achieving lower power consumption.

Means for Solving the Problems

An air conditioner according to the present invention includes a refrigerating cycle including a compressor compressing a refrigerant, an indoor heat exchanger exchanging heat between the refrigerant and the indoor air, a pressure-reducing expansion mechanism reducing pressure of and expanding the refrigerant, and an outdoor heat exchanger exchanging heat between the refrigerant and the outdoor air. The air conditioner according to the present invention further has a base plate arranged below the outdoor heat exchanger and having a drain outlet formed at a position opposing the undersurface of the outdoor heat exchanger, and a freeze prevention pipe arranged between the outdoor heat exchanger and the base plate in a manner, in plan view, to at least partially pass inside the region of the drain outlet. The freeze prevention pipe is connected between the outdoor heat exchanger and the indoor heat exchanger.

Effects of The Invention

According to the present invention, discharge of drain water can be maintained by preventing drain water from freezing or by thawing frozen drain water, while achieving lower power consumption by efficiently utilizing the heat from a freeze prevention pipe.

DESCRIPTION OF THE REFERENCE SIGNS

10 compressor, 20 four-way valve, 30 indoor heat exchanger, 40 refrigerant piping, 41 freeze prevention pipe, 42 the bottom piping, 50 expansion valve, 60 outdoor heat exchanger, 61 fin, 70 base plate, 71 drain outlet, 80 water shield wall, 90 ice, 100 outdoor unit, 200 indoor unit.

BEST MODES FOR CARRYING OUT THE INVENTION

An air conditioner in the embodiments based on the present invention will be hereinafter described with reference to the drawings.

First Embodiment

Figure 1:
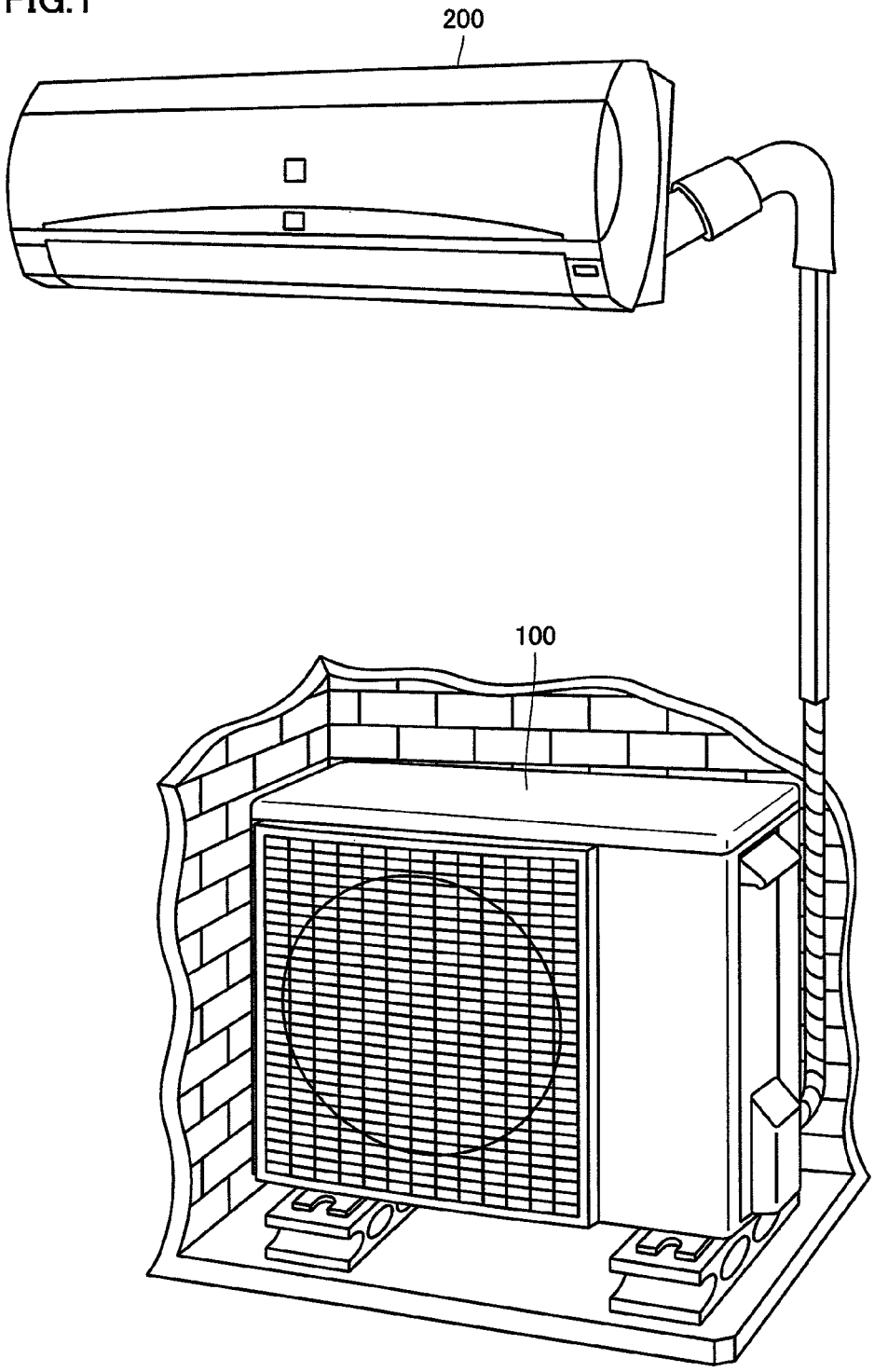
FIG. 1 is an external perspective view of an outdoor unit and an indoor unit constituting an air conditioner.

FIG. 1 is an external perspective view of an outdoor unit and an indoor unit constituting an air conditioner. As shown in FIG. 1, an outdoor unit 100 is used being arranged outdoor and an indoor unit 200 is used being arranged indoor. Outdoor unit 100 of an air conditioner used in the severely cold region is placed in a subfreezing environment.

Figure 2:
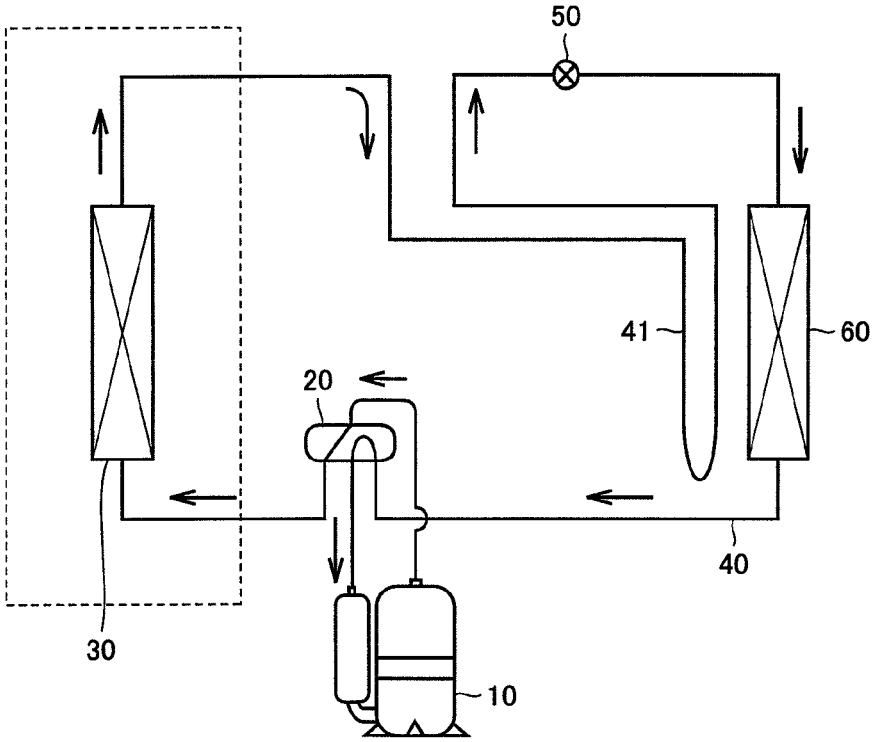
FIG. 2 illustrates a refrigerating cycle of an air conditioner in heating operation according to a first embodiment of the present invention.
Figure 3:
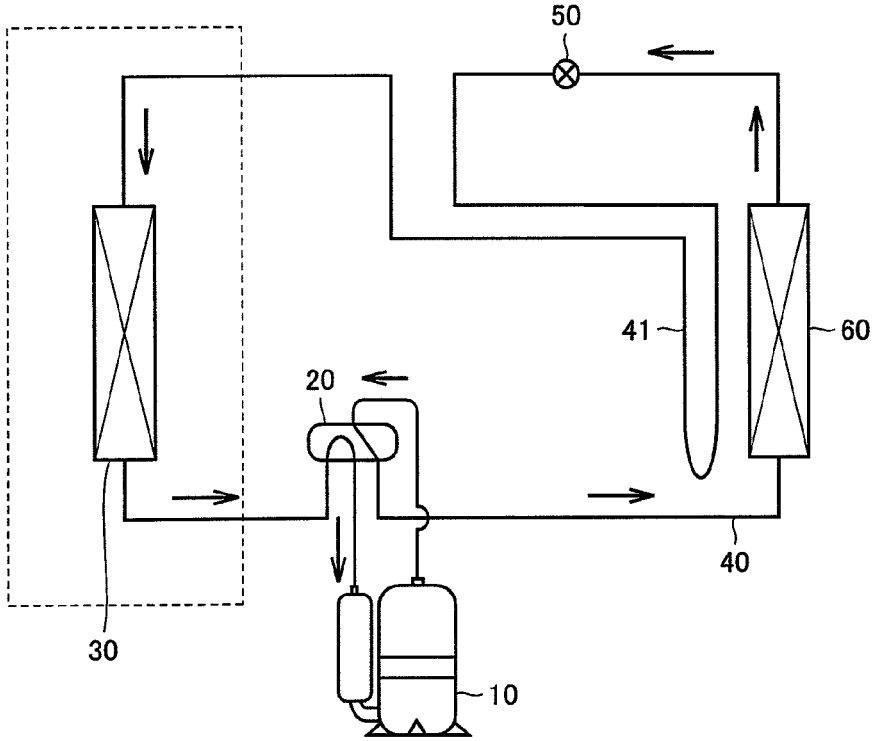
FIG. 3 illustrates a refrigerating cycle of the air conditioner in defrosting operation according to the same embodiment.

With reference to FIGS. 2 and 3, a refrigerating cycle of an air conditioner will be described. FIG. 2 illustrates a refrigerating cycle of an air conditioner in heating operation according to a first embodiment of the present invention. FIG. 3 illustrates a refrigerating cycle of the air conditioner in defrosting operation according to the present embodiment. As shown in FIGS. 2 and 3, a compressor 10, a four-way valve 20, an indoor heat exchanger 30, an expansion valve 50, an outdoor heat exchanger 60 and the like are connected by refrigerant piping 40 to constitute the air conditioner. A freeze prevention pipe 41 is connected between indoor heat exchanger 30 and outdoor heat exchanger 60.

As shown in FIG. 2, in heating operation, a refrigerant which is discharged from compressor 10 and in a high-temperature and high-pressure gaseous state is sent via four-way valve 20 to indoor heat exchanger 30. At this time, indoor heat exchanger 30 functions as a condenser, and the refrigerant reliquefies by dissipating heat to the indoor air. The refrigerant which has passed through indoor heat exchanger 30 then passes through freeze prevention pipe 41 and expansion valve 50 to arrive at outdoor heat exchanger 60. Expansion valve 50, which is a pressure-reducing expansion mechanism, reduces pressure of the refrigerant and expands the refrigerant to lower the boiling point of the refrigerant. Outdoor heat exchanger 60 functions as an evaporator, and the liquid refrigerant which has passed through expansion valve 50 and now has a lower boiling point evaporates, drawing evaporation heat from the surroundings in outdoor heat exchanger 60. Thereafter, the refrigerant is sent via four-way valve 20 to compressor 10. Compressor 10 compresses the refrigerant into a high-temperature and high-pressure gaseous state. The air conditioner in heating operation has a refrigerating cycle configured to circulate a refrigerant in this way.

As shown in FIG. 3, in defrosting operation, a refrigerant which is discharged from compressor 10 and in a high-temperature and high-pressure gaseous state is sent via four-way valve 20 to outdoor heat exchanger 60. At this time, outdoor heat exchanger 60 functions as a condenser, and the refrigerant reliquefies by dissipating the heat to the surroundings. The refrigerant which has passed through outdoor heat exchanger 60 then passes through expansion valve 50 and freeze prevention pipe 41 to arrive at indoor heat exchanger 30. Expansion valve 50 reduces pressure of the refrigerant and expands the refrigerant to lower the boiling point of the refrigerant. Indoor heat exchanger 30 functions as an evaporator, and the liquid refrigerant which has passed through expansion valve 50 and now has a lower boiling point evaporates, drawing evaporation heat from the surroundings in indoor heat exchanger 30. Thereafter, the refrigerant is sent via four-way valve 20 to compressor 10. Compressor 10 compresses the refrigerant into a high-temperature and high-pressure gaseous state. The air conditioner in defrosting operation has a refrigerating cycle configured to circulate a refrigerant in this way.

Figure 4:
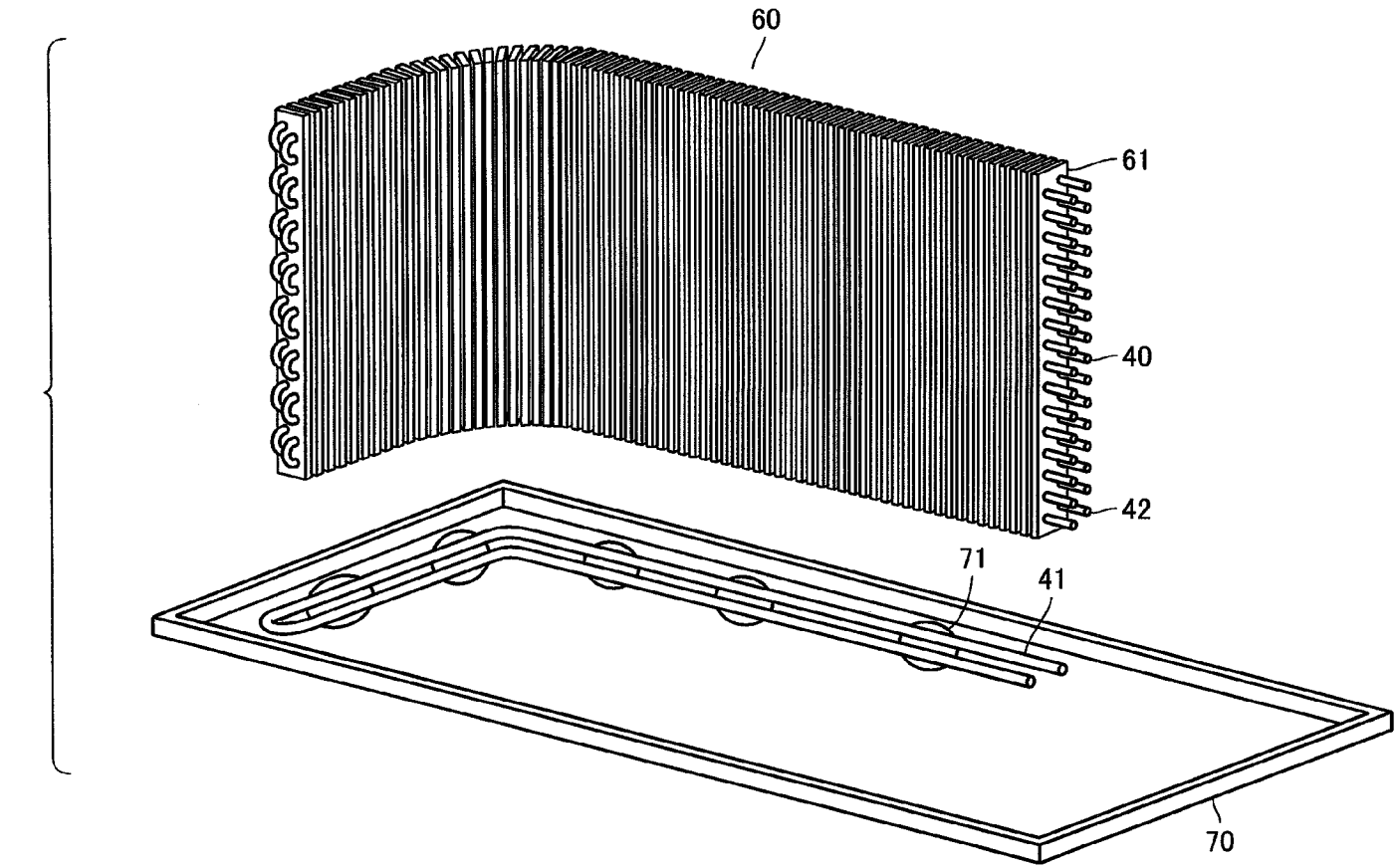
FIG. 4 is an exploded perspective view illustrating an outdoor heat exchanger, a freeze prevention pipe and a base plate within the outdoor unit according to the same embodiment.
Figure 5:
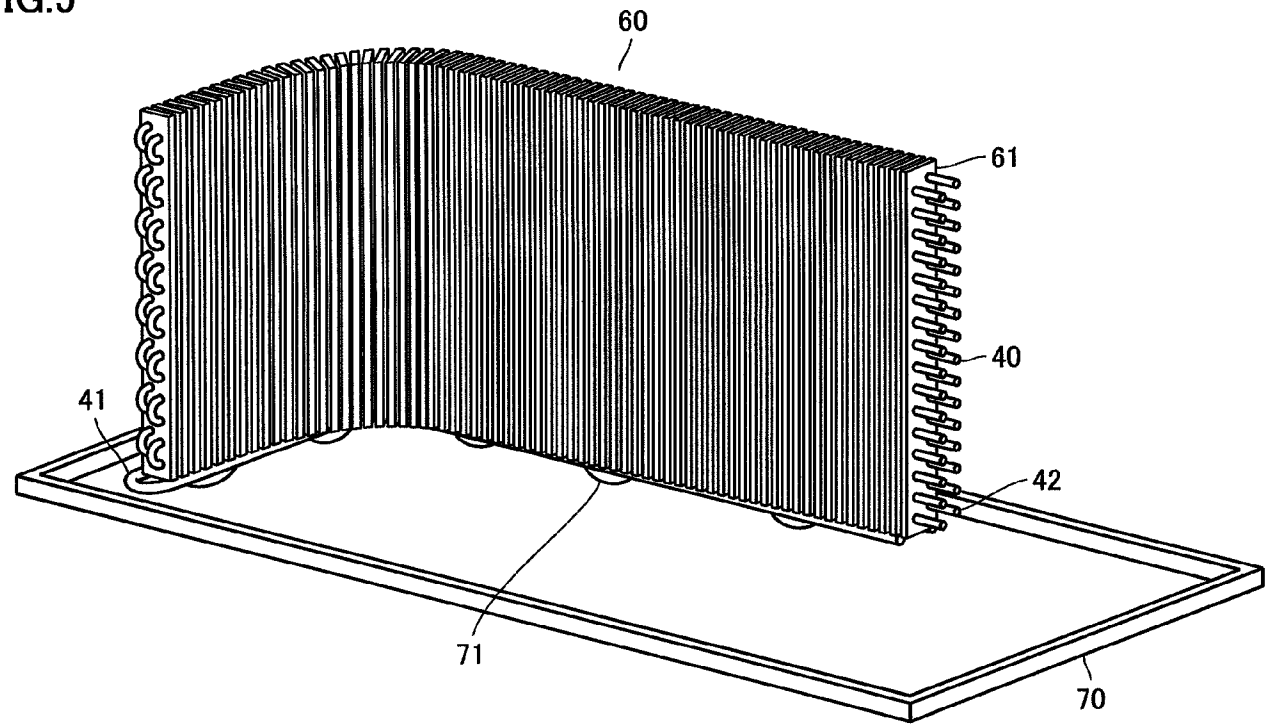
FIG. 5 is a perspective view illustrating an arrangement relationship between the outdoor heat exchanger, the freeze prevention pipe and the base plate within the outdoor unit according to the same embodiment.

The outdoor unit of the air conditioner according to the present embodiment will be hereinafter described with reference to FIGS. 4-7. FIG. 4 is an exploded perspective view illustrating the outdoor heat exchanger, the freeze prevention pipe and a base plate within the outdoor unit according to the present embodiment. FIG. 5 is a perspective view illustrating an arrangement relationship between the outdoor heat exchanger, the freeze prevention pipe and the base plate within the outdoor unit according to the present embodiment. As shown in FIG. 4, arranged below outdoor heat exchanger 60 is a base plate 70, and disposed between outdoor heat exchanger 60 and base plate 70 is freeze prevention pipe 41. As shown in FIG. 5, outdoor heat exchanger 60 is arranged in a manner to overlie freeze prevention pipe 41.

At outdoor heat exchanger 60, a plurality of fins 61 each having an approximately rectangular shape are arrayed with the longitudinal direction vertically directed, being spaced apart by a small clearance, and in parallel to one another. Refrigerant piping 40 is provided in a manner to horizontally penetrate through a formed group of fins. This configuration increases the surface area of outdoor heat exchanger 60 and ensures the contact area with the surrounding air available for heat exchange with a refrigerant.

In base plate 70, a plurality of drain outlets 71 are provided at positions opposing the undersurface of outdoor heat exchanger 60. Drain water flowed out from outdoor heat exchanger 60 is collected on base plate 70 and discharged from drain outlet 71 to the outside. Since a plurality of drain outlets 71 are provided, it is only necessary for drain water to be discharged at any of drain outlets 71, and the possibility of drain failure is decreased. Freeze prevention pipe 41 is arranged between outdoor heat exchanger 60 and base plate 70 in a manner, in plan view, to pass through inside the regions of drain outlets 71. For freeze prevention pipe 41, a material with good thermal conductivity is used, for example, a copper pipe or the like is used. In the present embodiment, the outer diameter of the piping of outdoor heat exchanger 60 and the outer diameter of the piping of freeze prevention pipe 41 are the same, however, they may differ from each other. For example, refrigerant piping 40 of outdoor heat exchanger 60 may have an outer diameter of 7 mm and the piping of freeze prevention pipe may have an outer diameter of 6.35 mm, such that the outer diameter of the piping of outdoor heat exchanger 60 is larger than the outer diameter of the piping of freeze prevention pipe 41. It is noted that in the present embodiment, freeze prevention pipe 41 is arranged such that the pipe, in plan view, entirely passes inside the regions of drain outlets 71; however, freeze prevention pipe 41 may be arranged such that the pipe, in plan view, at least partially passes inside regions of drain outlets 71.

Figure 6:
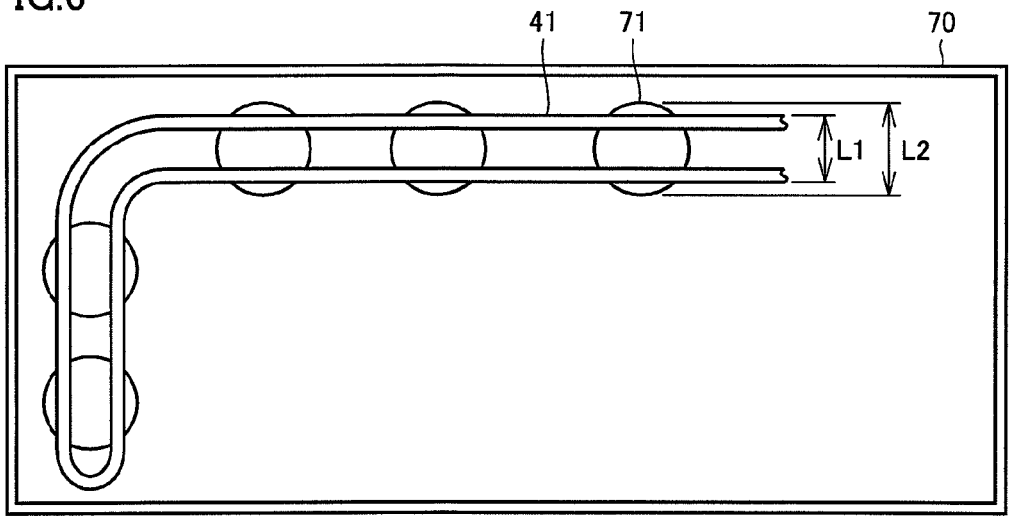
FIG. 6 is a plan view illustrating a planer arrangement relationship between drain outlets formed in the base plate and the freeze prevention pipe, according to the same embodiment.
Figure 7:
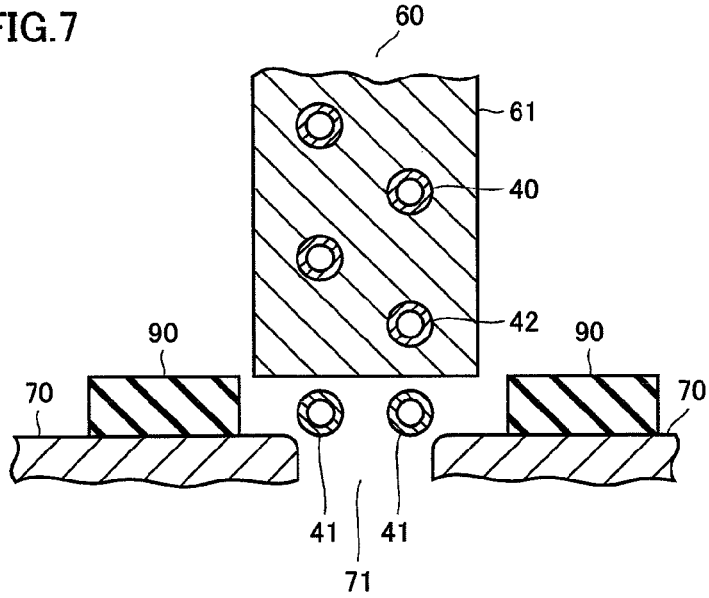
FIG. 7 is a cross-sectional view illustrating a lateral arrangement relationship between the drain outlet formed in the base plate, the freeze prevention pipe, and the outdoor heat exchanger, according to the same embodiment.

FIG. 6 is a plan view illustrating a planer arrangement relationship between the drain outlets formed in the base plate and the freeze prevention pipe, according to the present embodiment. FIG. 7 is a cross-sectional view illustrating a lateral arrangement relationship between the drain outlets formed in the base plate, the freeze prevention pipe, and the outdoor heat exchanger, according to the present embodiment. As shown in FIG. 6, freeze prevention pipe 41 has a U-shaped turning part, so that a section where freeze prevention pipes 41 are arranged in parallel to each other is formed in freeze prevention pipe 41. In this section, a spacing L1 between outer sides of freeze prevention pipes 41 is formed to be smaller than width L2 of drain outlet 71 in the orthogonal direction to a direction along which freeze prevention pipe 41 extends. Formed in this way, when freeze prevention pipe 41 and base plate 70 are arranged in contact with each other, a contact portion between the freeze prevention pipe 41 and the base plate 70 can be reduced. As a result, the amount of heat dissipated through base plate 70 can be reduced, and a larger amount of heat can be given to ice which exists in the vicinity of drain outlets 71.

Also, since freeze prevention pipe 41 is arranged to pass inside the region of drain outlet 71, a portion of drain outlet 71 (L2-L1) exists outside freeze prevention pipe 41. This allows drain water and the like flowing in from outside freeze prevention pipe 41 to be discharged from a portion of drain outlet 71 (L2-L1). Further, arranging freeze prevention pipe 41 in a manner to allow a portion of drain outlet 71 to exist on both outer sides of freeze prevention pipes 41 arranged in parallel to each other, allows drain water on both outer sides of freeze prevention pipes 41 to be discharged from a portion of drain outlet 71. As shown in FIG. 7, drain outlet 71 and freeze prevention pipe 41 may be arranged out of contact with each other. With this arrangement, freeze prevention pipe 41 does not block drain outlet 71 and does not hinder discharge of drain water from drain outlet 71. Further, since a refrigerant flowing through freeze prevention pipe 41 passes over drain outlet 71 twice, it becomes easier to heat ice 90 in the vicinity of drain outlet 71.

Next, defrosting action in the air conditioner in the present embodiment will be described. As described before, once heating operation is started, a refrigerant at a high temperature and discharged from compressor 10 is sent via four-way valve 20, indoor heat exchanger 30, freeze prevention pipe 41, expansion valve 50, outdoor heat exchanger 60, and four-way valve 20 to compressor 10. The temperature of the refrigerant when passed through indoor heat exchanger 30 and arriving at freeze prevention pipe 41 is maintained at not less than 0° C. Therefore, the surface temperature of freeze prevention pipe 41 is higher than the temperature of ice 90 which exists in the proximity of freeze prevention pipe 41, and the heat dissipated from the refrigerant heats ice 90. For example, ice 90 at a temperature of −20° C. can be heated by freeze prevention pipe 41 to an elevated temperature of about −7° C.

When continuous heating operation causes frost formation to progress at outdoor heat exchanger 60, operation of the air conditioner switches to defrosting operation. As described before, once defrosting operation is started, a refrigerant at a high temperature and discharged from compressor 10 is sent via four-way valve 20, outdoor heat exchanger 60, expansion valve 50, freeze prevention pipe 41, indoor heat exchanger 30, and four-way valve 20 to compressor 10. At this time, the refrigerant at a high temperature flows from the bottom piping 42 into outdoor heat exchanger 60, which causes a lower part of outdoor heat exchanger 60 to be the warmest location in outdoor heat exchanger 60. For this reason, initially, frost at the lower part of outdoor heat exchanger 60 is thawed, and frost at an upper part is gradually thawed. When defrosting progresses on outdoor heat exchanger 60, warm thaw water of melted frost drips down in the proximity of ice 90 freezing on base plate 70. Ice 90 in the vicinity of freeze prevention pipe 41 is easily dissolved upon mixing with this thaw water, since the ice was heated in heating operation to have an elevated temperature. When drain outlet 71 is blocked by ice 90, a concave dent is formed in ice 90 at a portion dissolved by thaw water, and further, thaw water flows into the dent, thereby facilitating dissolution of ice 90. This results in that drain outlet 71 can be opened to maintain discharge of drain water. It is noted that also when drain outlet 71 is not blocked by ice 90, dissolution of ice 90 progresses from a portion mixed with thaw water, and thus drain outlet 71 can be kept open.

If ice 90 which exists in the vicinity of drain outlet 71 were not pre-heated by freeze prevention pipe 41 in heating operation, ice 90 in the vicinity of drain outlet 71 could not be effectively dissolved by thaw water alone. Consequently, there is a possibility that thaw water accumulates on base plate 70 as being cooled and that ice 90 grows to lead to destruction of outdoor heat exchanger 60, an outdoor fan and the like. In the present embodiment, since ice 90 which exists in the vicinity of drain outlet 71 is pre-heated by freeze prevention pipe 41 in heating operation, it can be ensured that drain outlet 71 is open, and drain failure can be made unlikely. It is noted that more preferably, outdoor heat exchanger 60 and freeze prevention pipe 41 are arranged out of contact with each other. Arrangement in such a manner can prevent direct heat exchange between freeze prevention pipe 41 at a high temperature and outdoor heat exchanger 60 at a low temperature in heating operation. This results in that freeze prevention pipe 41 can sufficiently heat ice 90, and that the dissolution efficiency of ice 90 can be maintained high.

Second Embodiment

Figure 8:
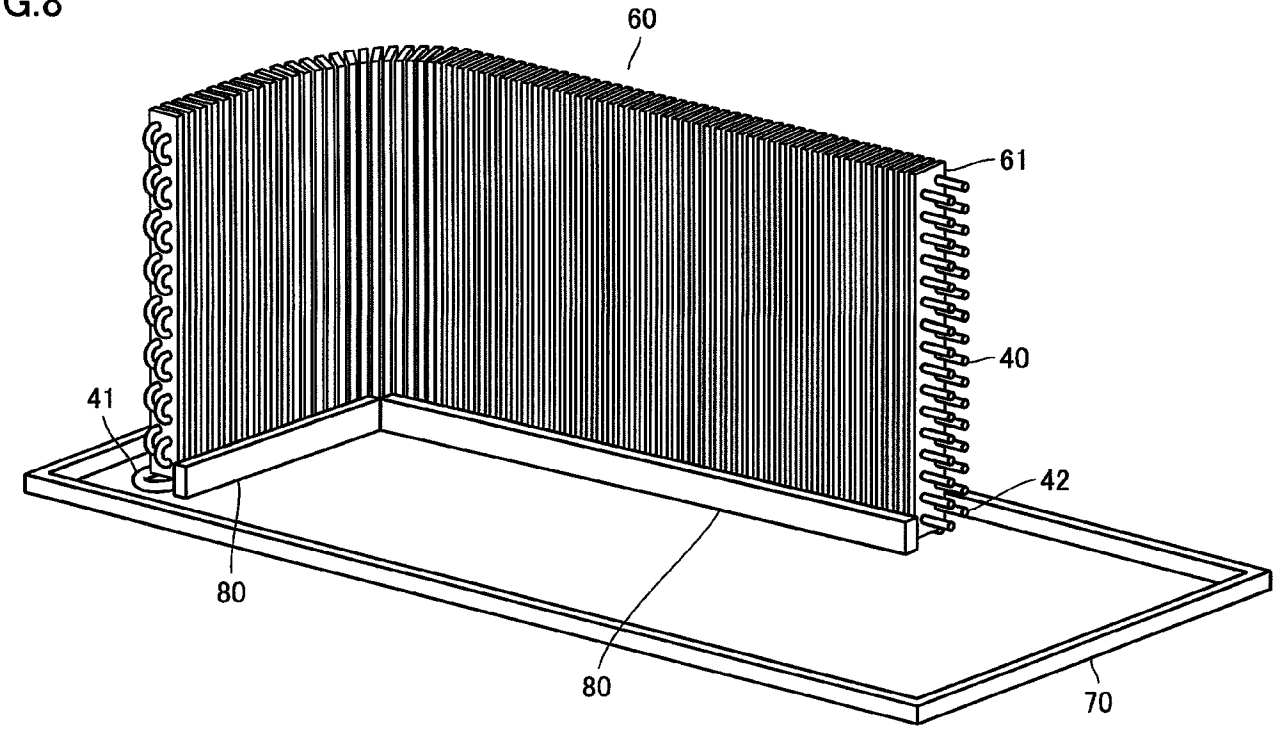
FIG. 8 is a perspective view illustrating an arrangement relationship between an outdoor heat exchanger, a freeze prevention pipe, a base plate, and a water shield wall within an outdoor unit according to a second embodiment of the present invention.
Figure 9:
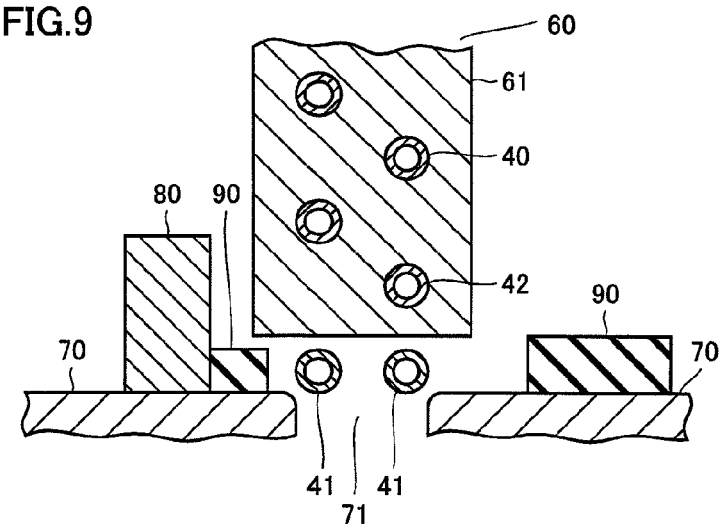
FIG. 9 is a cross-sectional view illustrating a lateral arrangement relationship between the drain outlet formed in the base plate, the freeze prevention pipe, the outdoor heat exchanger, and the water shield wall, according to the same embodiment.

Next, an air conditioner of a second embodiment of the present invention will be described with reference to FIGS. 8 and 9. The air conditioner of the second embodiment has a configuration of the first embodiment with an addition of water shield wall 80. FIG. 8 is a perspective view illustrating an arrangement relationship between outdoor heat exchanger 60, freeze prevention pipe 41, the base plate, and a water shield wall within an outdoor unit according to the second embodiment. FIG. 9 is a cross-sectional view illustrating a lateral arrangement relationship between the drain outlet formed in the base plate, the freeze prevention pipe, the outdoor heat exchanger, and the water shield wall, according to the present embodiment. The air conditioner according to the present embodiment has the same configuration as that of the first embodiment except water shield wall 80, and therefore, elements other than water shield wall 80 will not be described.

As shown in FIGS. 8 and 9, water shield wall 80 is provided on base plate 70 in a manner to run along the proximity of a lower part of outdoor heat exchanger 60. By providing this water shield wall 80, warm thaw water flowing out of outdoor heat exchanger 60 in defrosting operation is prevented from spreading over base plate 70 and made to flow in the vicinity of drain outlet 71 in a concentrated manner. Further, even when it is windy and snowing hard, likelihood of snow entering from an exhaust side (front side) of an outdoor fan and intruding between outdoor heat exchanger 60 and drain outlet 71 can be reduced. It is noted that since an intake side (back side) of the outdoor fan is placed to be close to a wall of a building, it is unlikely that snow enters therefrom. In the present embodiment, water shield wall 80 is provided on only one side of outdoor heat exchanger 60, because there is a sidewall of base plate 70 on the opposite side, and the sidewall acts as a water shield wall. It is noted that water shield wall 80 may be provided on both sides of outdoor heat exchanger 60.

Figure 10:
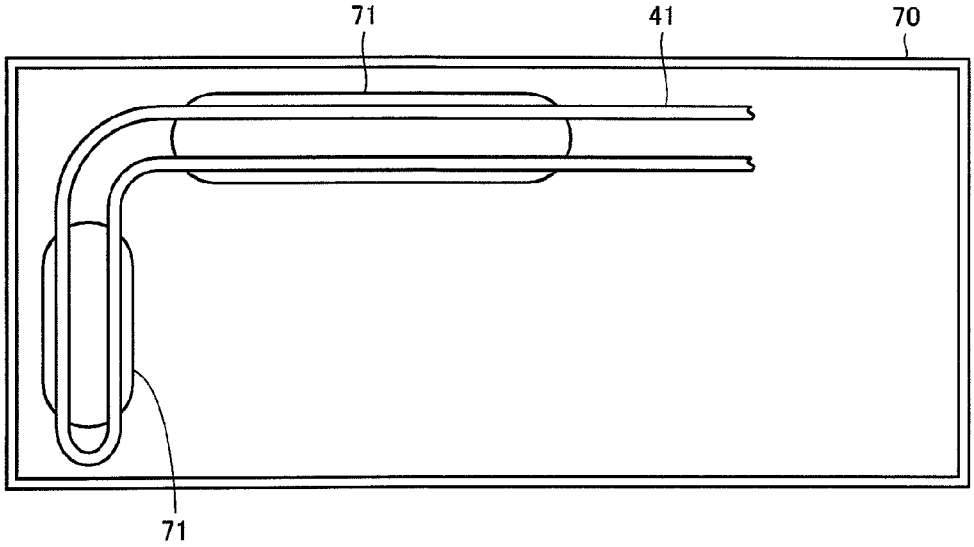
FIG. 10 is a plan view illustrating oval drain outlets formed in a base plate.

As a modification of the first and second embodiments, the shape of drain outlet 71 may be an oval shape having the longitudinal direction in a direction along which freeze prevention pipe 41 extends. FIG. 10 is a plan view illustrating oval drain outlets 71 formed in base plate 70. When drain outlet 71 is in an oval shape, drain outlet 71 has a larger area, and frost fell off from outdoor heat exchanger 60 without dissolving in defrosting operation is less likely to block drain outlet 71. As a result, easier discharge of frost can be achieved.

It should be noted that foregoing embodiments disclosed herein are by way of illustration in every respect and not to be taken by way of limitation. Therefore, the technical scope of the present invention is not construed only by the above-described embodiments, but defined based on the recitation of claims and includes all modifications equivalent in meaning and scope to the claims.

The invention claimed is:

1. An air conditioner comprising:

a refrigerating cycle including:

a compressor compressing a refrigerant;

an indoor heat exchanger exchanging heat between said refrigerant and indoor air;

a pressure-reducing expansion mechanism reducing pressure of and expanding said refrigerant; and an outdoor heat exchanger exchanging heat between said refrigerant and outdoor air and including:

a group of fins formed of a plurality of fins each having rectangular shape and arrayed with a longitudinal direction vertically directed, being spaced apart such that the fins are not in physical contact with one another, and in parallel to one another; and a refrigerant piping provided to horizontally penetrate through said group of fins, said air conditioner including:

a base plate arranged below said outdoor heat exchanger and having a drain outlet formed as a through hole at a position opposing an undersurface of said outdoor heat exchanger; and a freeze prevention pipe having two portions connected by a turning part, and arranged between said outdoor heat exchanger and said base plate in a manner, in plain view, to at least partially pass across a region of said drain outlet, arranged so that a portion of the through hole of the drain outlet exists on respective outer sides of said two portions of said freeze prevention pipe, and to be along and out of contact with the undersurface of said outdoor heat exchanger, said freeze prevention pipe being connected in series between said outdoor heat exchanger and said indoor heat exchanger in said refrigerating cycle, said freeze prevention pipe has said turning part, so that a section where the two portions of said freeze prevention pipes are arranged in parallel to each other is formed, and in said section a spacing between outer sides of said two parallel portions of said freeze prevention pipe is smaller than a width of said drain outlet in an orthogonal direction to a direction along which said freeze prevention pipe extends, throughout the entire period of heating operation, said refrigerant in a high-temperature state being discharged from said compressor toward said indoor heat exchanger and via said indoor heat exchanger, passing through said freeze prevention pipe before flowing into said outdoor heat exchanger, and in defrosting operation switched from the heating operation so that the direction of the flow of the refrigerant in the outdoor heat exchanger is reversed, said refrigerant in a high-temperature state is discharged from said compressor toward said outdoor heat exchanger, said refrigerant at a high temperature flowing from said refrigerant piping at a bottom portion of said outdoor heat exchanger into said outdoor heat exchanger and exchanging heat before flowing into said freeze prevention pipe, whereby frost is thawed from a lower portion to an upper portion of said outdoor heat exchanger and thaw water dripping down affects ice at or in the vicinity of said drain outlet heated by said freeze prevention pipe throughout the entire period of heating operation to have an elevated temperature, and thawing of said ice is facilitated.

2. The air conditioner according to claim 1, wherein said outdoor heat exchanger serves as a condenser in defrosting operation, and an inlet of piping located at a bottom of said refrigerant piping serves as an inlet of the condenser in defrosting operation.

3. The air conditioner according to claim 1, wherein said freeze prevention pipe is out of contact with both of said outdoor heat exchanger and said drain outlet.

4. The air conditioner according to claim 1, wherein said drain outlet has an oval shape and said oval shape has a longitudinal direction in a direction along which said freeze prevention pipe extends.

5. The air conditioner according to claim 1, wherein a water shield wall is provided on said base plate in the proximity of said drain outlet in a manner to run along said outdoor heat exchanger.

* * * * *